US007846300B2

(12) United States Patent
Faix et al.

(10) Patent No.: US 7,846,300 B2
(45) Date of Patent: Dec. 7, 2010

(54) RAIL FOR THE COMPLIANT SUPPORTING OF A MESH, AND DOUBLE MESH SECTION

(75) Inventors: Helmut Faix, Giengen (DE); Peter Martin, Langenau (DE)

(73) Assignee: Voith Patent GmbH, Heidenheim (DE)

( * ) Notice: Subject to any disclaimer, the term of this patent is extended or adjusted under 35 U.S.C. 154(b) by 370 days.

(21) Appl. No.: 12/128,432

(22) Filed: May 28, 2008

(65) Prior Publication Data

US 2008/0283209 A1 Nov. 20, 2008

Related U.S. Application Data

(63) Continuation of application No. PCT/EP2006/069085, filed on Nov. 30, 2006.

(30) Foreign Application Priority Data

Dec. 5, 2005 (DE) ..... 10 2005 000 175

(51) Int. Cl.
*D21F 1/00* (2006.01)

(52) U.S. Cl. ..... 162/352; 162/272; 162/354; 162/301; 162/374

(58) Field of Classification Search ..... 162/352, 162/354, 301, 272, 374
See application file for complete search history.

(56) References Cited

U.S. PATENT DOCUMENTS 5,262,010 A * 11/1993 Bubik et al. ..... 162/352
5,486,270 A * 1/1996 Schiel ..... 162/352
5,507,918 A * 4/1996 Polifke et al. ..... 162/301
5,690,792 A * 11/1997 Jaakkola et al. ..... 162/301
6,039,843 A * 3/2000 Wight ..... 162/352
6,302,399 B1 10/2001 Prinzing
6,379,503 B1 * 4/2002 Jansson ..... 162/199

FOREIGN PATENT DOCUMENTS

DE 4009627 A1 10/1991
DE 4019884 A1 1/1992

* cited by examiner

*Primary Examiner*—Mark Halpern
(74) *Attorney, Agent, or Firm*—Taylor IP, P.C.

(57) ABSTRACT

This invention relates to a rail for the compliant supporting of a mesh in the region of a double mesh zone of a double mesh section of a machine for producing a fibrous web, including a movable head rail, a movable bearer rail, a fixed guide rail, a compliant pressing apparatus, and a compliant return apparatus for moving the movable bearer rail together with the movable head rail from the operating position to the resting position and for holding the two rails in the resting position. The compliant return apparatus has, spread over the length of the movable bearer rail, several movable return hoops which at the one end can be made to engage at least temporarily with the movable bearer rail and at the other end can be loaded at least temporarily by at least one return element respectively arranged between the fixed guide rail and the movable return hoop.

28 Claims, 3 Drawing Sheets

RAIL FOR THE COMPLIANT SUPPORTING OF A MESH, AND DOUBLE MESH SECTION

CROSS REFERENCE TO RELATED APPLICATIONS

This is a continuation of PCT application No. PCT/EP2006/069085, entitled "STRIP FOR FLEXIBLY SUPPORTING A WIRE AND TWIN-WIRE SECTION", filed Nov. 30, 2006, which is incorporated herein by reference.

BACKGROUND OF THE INVENTION

1. Field of the Invention

This invention relates to a rail for the compliant supporting of a mesh in the region of a double mesh zone of a double mesh section of a machine for producing a fibrous web.

Also, the invention relates to a double mesh section of a machine for producing a fibrous web, in particular a paper web or paperboard web.

2. Description of the Related Art

Such a rail is known for example from the German publication DE 40 19 884 A1. In this case the compliant return apparatus for returning the movable bearer rail to the resting position is a source of return power, preferably a spring.

This is a disadvantage in that at least the return force has to be overcome when moving the movable bearer rail from the resting position to the operating position. Also, while the movable bearer rail is held in its operating position a force which is at least greater than the return force has to be applied continuously so that the movable bearer rail remains reliably in the desired operating position during operation. This actuating mechanism thus requires, at least while the machine is in operation, the application of a force which is far greater than the force which needs to be applied for holding the movable bearer rail in the operating position.

What is needed in the art is to improve a rail of the type initially referred to such that its positions, in particular its operating position and resting position, can be adopted and held reliably during operation with the application of far less force. In particular the return mechanism of the rail should have largely no effect on the holding forces of said rail when the rail is in its operating position. Also, a corresponding double mesh section will be disclosed.

SUMMARY OF THE INVENTION

The present invention provides a rail for the compliant supporting of a mesh in the region of a double mesh zone of a double mesh section of a machine for producing a fibrous web, in particular a paper web or paperboard web, including a movable head rail, which extends transverse to the running direction of the mesh and over which the mesh slides at least in some regions during operation of the machine, a movable bearer rail, which is rigidly connected to the movable head rail and extends likewise transverse to the running direction of the mesh and is guided in a fixed structure, a fixed guide rail, which is rigidly arranged in the fixed structure and extends in turn transverse to the running direction of the mesh, a compliant pressing apparatus, which is arranged between the movable bearer rail and the fixed guide rail in order to move the movable bearer rail together with the moveable head rail between a resting position and an operating position in which the movable head rail can be pressed with a selectable force onto the mesh, and a compliant return apparatus for moving the movable bearer rail together with the movable head rail from the operating position to the resting position and for holding the two rails in the resting position. The compliant return apparatus has, spread over the length of the movable bearer rail, several movable return hoops which at the one end are made to engage at least temporarily with the movable bearer rail and at the other end can be loaded at least temporarily by at least one return element respectively arranged between the fixed guide rail and the movable return hoop.

Said inventive return apparatus ensures, as the result of its design in the form of several movable return hoops with at least temporary engagement, that said hoops do not act continuously on the rail and thus do not represent forces which have to be continuously overcome. Hence no return force applied by the return apparatus according to the prior art has to be overcome any longer in order to move the rail from its resting position to an operating position or from an operating position to a changed operating position. Furthermore, the inventive return mechanism is largely insensitive to soiling of all kinds. The complete rail system is characterized in addition by a compact design such that it can be arranged for example even in the initial dewatering region of the double mesh section, in particular directly after a forming element, preferably a forming roll.

In a first embodiment the movable bearer rail has at least one, preferably several depressions into which the one ends of the movable return hoops can be engaged at least temporarily. In the case of one depression said depression would extend along the moveable bearer rail. Preferably however the number of depressions is equal to the number of the one ends so that a corresponding end can engage in each depression at least temporarily. The depression is in this case preferably a rectangular recess.

From practical points of view the respective return element is constructed preferably as a return hose which can be loaded with a pressure at least temporarily. In this case it extends preferably at least between the two edge-side return hoops along the fixed guide rail. In the case in question it will most likely extend over the complete or nearly complete length of the fixed guide rail so that it is easily accessible at least on the drive end or operator end. Of course it is also possible for a return element to be provided for each return hoop, which however can result in disadvantages in terms of cost and effort.

In addition, at least in some regions the preferably one return hose is guided in respect of its circumference, in particular at least on the bottom side, in a depression constructed on the upper side of the fixed guide rail. This type of guidance ensures on the one hand that said hose is safely guided during operation and on the other hand that said hose is protected and cleanly stored during its resting phase.

On the one end of the respective return hoop there is attached on the inner side preferably a centering element, in particular a centering pin. Said centering element can be loaded at least temporarily, meaning during operation of the return apparatus, by a longitudinal rib constructed on the return hose on the upper side. Said construction ensures a favorable and reproducible loading of the return hoop by the return hose.

For the functional reliability of the return hoop to be continuously assured, said hoop is guided on both sides and in limits preferably by way of several guide elements, in particular guide pins, fitted in the fixed structure. The cleverly arranged guide elements thus limit the maximum displacement path of the return hoop and define among other things its resting position which it adopts as the result of its weight-related force.

Furthermore the fixed structure in a preferred embodiment includes several preferably triangular partition plates, which are arranged mutually spaced on a bearer element extending transverse to the running direction of the mesh as well as in the region of the return hoop and which enclose at least the fixed guide rail and the movable bearer rail at least partly like a clamp. As the result of their design and arrangement, such partition plates provide maximum stability for the rail system while weighing relatively little.

The bearer element has on the side facing away from the partition plates preferably several T-groove guides for its attachment to an additional component. This type of attachment has among other things the practical advantage of the complete rail system being separately removable without a major machine stoppage. If necessary it is thus possible for example for it to be replaced by a known rail system with a fixed rail arrangement. The same is also possible of course in the reverse case.

So that the tightness of the adjustment space for the rail adjustment is assured without friction losses on the rail body, the partition plates are equipped on their side facing the mesh with a rear wall extending transverse to the running direction of the mesh. In a favorable embodiment the rear wall is fitted by way of at least one guide rail to the partition walls so that it can easily be taken out of the machine if necessary.

In addition the partition walls can also be equipped on their side facing away from the mesh preferably with a front wall extending transverse to the running direction of the mesh. Said front wall lends in turn an additional amount of stability to the rail system in ensuring the previously mentioned tightness. In a favorable embodiment seal elements extending transverse to the running direction of mesh are arranged in this case in addition between the front wall and the movable bearer rail at least in some sections, in particular between the partition plates. From practical points of view the seal elements are constructed as a rule as precisely fitting seal rails.

For the interior maintenance of the space formed from the bearer body, the rear wall and the front wall there is arranged in the upper region of the partition plates preferably a cleaning apparatus, in particular a spray tube, extending transverse to the running direction. Such a cleaning apparatus is already known from other applications in connection with a machine for producing a fibrous web. Hence its design and mode of operation will not be described here in any more detail.

Also, in a preferred embodiment provision is made for at least one return hoop with a preferably central longitudinal recess in which the corresponding partition wall is guided. In this case guide elements, in particular guide pins for guiding the return hoop are fitted to the partition wall. Said embodiment has the advantage of a force- and torque-reduced design with simultaneous functional reliability.

A practical embodiment of a double mesh section of a machine for producing a fibrous web, in particular a paper web or paperboard web, is characterized in particular by a skimmer rail and/or at least a dewatering rail which conforms in design and function to the inventive rail. From process technology points of view it is also possible of course for the double mesh section to have several dewatering rails arranged in the running direction of the mesh.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiment of the invention, and such exemplifications are not to be construed as limiting the scope of the invention in any manner.

DETAILED DESCRIPTION OF THE INVENTION

Figure 1:
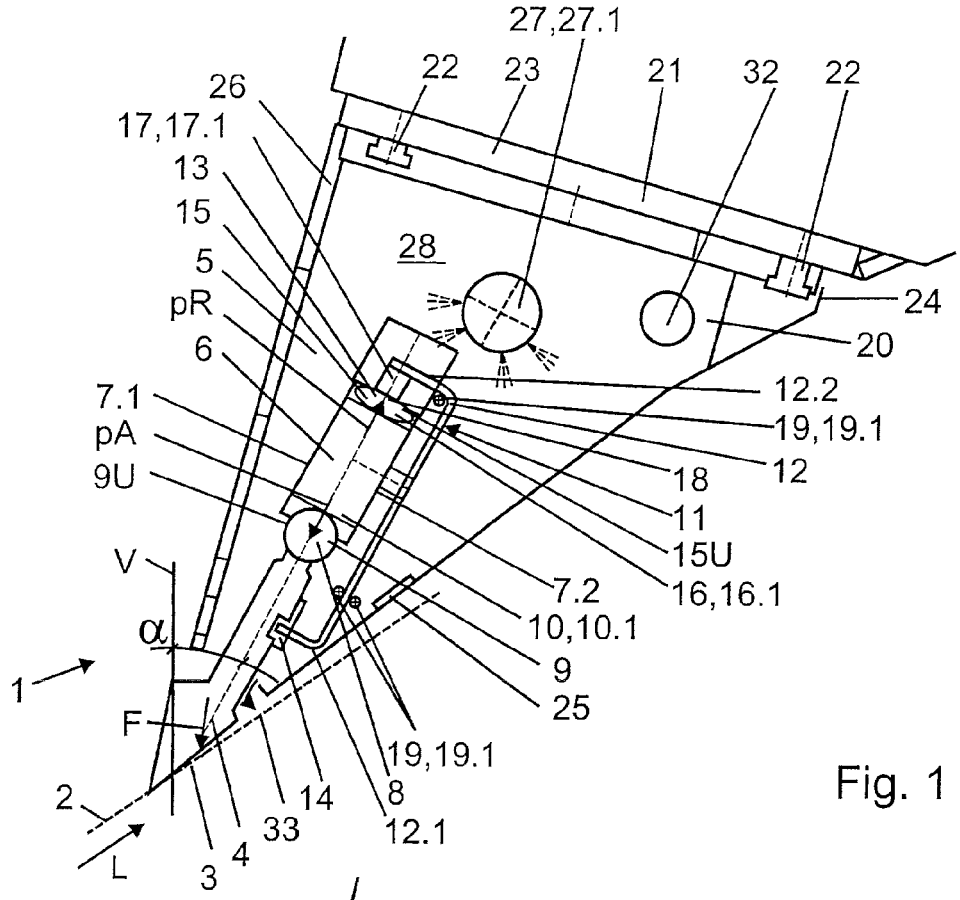
FIG. 1 is a schematic side view of the inventive rail in its operating position.

Referring now to the drawings, and more particularly to FIG. 1, there is shown a schematic side view of the rail 1 for the compliant supporting of a mesh 2 (represented by a dashed line) in the region of a double mesh section of a machine for producing a fibrous web, in particular a paper web or paperboard web, in its operating position. In the operating position the rail 1 is pressed into the mesh 2 in a range from 0.5 to 5 mm, preferably from 1 to 3 mm. The bar 1 can be aligned according to the run of the mesh 2 at an angle $\alpha$ of +/−90° to the vertical V.

The rail 1 includes a movable head rail 3, which extends transverse to the running direction L (arrow) of the mesh 2 and over which the mesh 2 slides at least in some regions during operation of the machine. The head rail 3 includes a ceramic material with a view to wear minimization on the mesh 2.

In addition the rail 1 includes a movable bearer rail 4, which is rigidly connected to the movable head rail 3 and extends likewise transverse to the running direction L (arrow) of the mesh 2 and is also guided in a fixed structure 5. In addition the rail 1 includes a fixed guide rail 6, which is rigidly arranged in the fixed structure 5 and extends in turn transverse to the running direction L (arrow) of the mesh 2. The rigid arrangement of the guide rail 6 in the fixed structure 5 can be effected for example by way of bilaterally arranged groove connections 7.1, 7.2 such that the guide rail 6 is removable from the machine transverse to the running direction L (arrow) of the mesh 2.

Arranged between the movable bearer rail 4 and the fixed guide rail 6 is a compliant pressing apparatus 8. Said apparatus serves to move the movable bearer rail 4 together with the movable head rail 3 between a resting position (FIG. 2) and the presented operating position in which the movable head rail 3 is pressed with a selectable force F (arrow) onto the mesh 2. The pressing apparatus 8 is constructed for example as a pressing hose 9 which during the operating phase is loaded with an operating pressure pA (arrow) by a pressure source (not illustrated but known to those skilled in the art), for example in the form of a pressure pump preferably with open-loop/closed-loop control. The pressing hose 9 extends preferably along the fixed guide rail 6 and at least in some regions is guided in respect of its circumference 9U, in particular at least on the top side, in a depression 10, in particular a groove 10.1, constructed on the bottom side of the fixed guide rail 6. The fixed guide rail 6 thus serves also as a carrier system for the pressing apparatus 8, in particular for the pressing hose 9.

Figure 2:
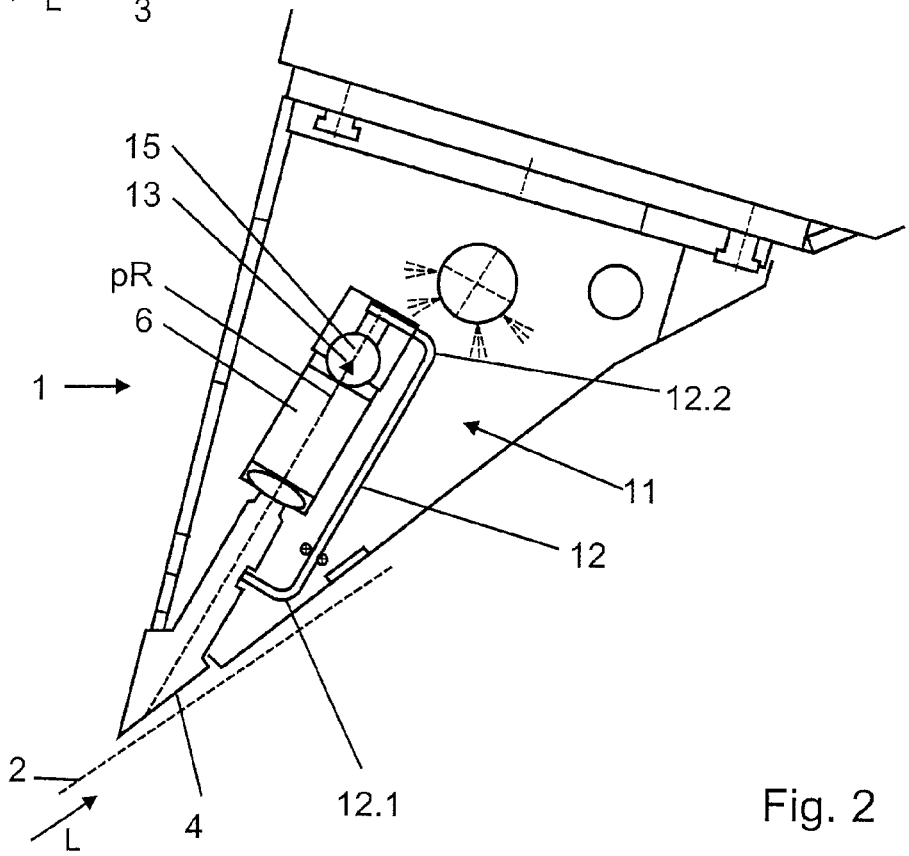
FIG. 2 is a schematic side view of the inventive rail from FIG. 1 in its resting position.

Furthermore the rail 1 includes a compliant return apparatus 11 for moving the movable bearer rail 4 together with the movable head rail 3 from the illustrated operating position to the resting position (FIG. 2) and for holding the two rails 3, 4 in the resting position (FIG. 2).

The compliant return apparatus 11 has, spread over the length of the movable bearer rail 4, several movable return hoops 12 which at the one end 12.1 can be made to engage at least temporarily with the movable bearer rail 4 and at the other end 12.2 can be loaded at least temporarily by at least one return element 13 respectively arranged between the fixed guide rail 6 and the movable return hoop 12. The temporary engaging and the temporary loading take place while the two rails 3, 4 are moved from the illustrated operating position to the resting position (FIG. 2) and while they are in the resting position (FIG. 2).

The movable bearer rail 4 has moreover several depressions 14 (FIG. 3) into which the one ends 12.1 of the movable return hoops 12 can be engaged at least temporarily. The individual depression 14 is preferably a rectangular recess.

Also, the respective return element 13 is constructed as a return hose 15 which can be loaded with a pressure pR (arrow) at least temporarily. The pressure pA (arrow) is again generated by a pressure source (not illustrated but known to those skilled in the art), for example in the form of a pressure pump preferably with open-loop/closed-loop control.

The return hose 15 extends at least between the two edge-side return hoops 12 along the fixed guide rail 6. In this case it is guided, at least in some regions, in respect of its circumference 15U, in particular at least on the bottom side, in a depression 16, in particular a groove 16.1, constructed on the upper side of the fixed guide rail 6. The fixed guide rail 6 thus serves also as a carrier system for the return hose 15.

On the one end 12.2 of the respective return hoop 12 there is attached on the inner side a centering element 17, in particular a centering pin 17.1. The centering pin 17.1 can be loaded at least temporarily by a longitudinal rib 18 constructed on the return hose 15 on the upper side.

Also, the return hoop 12 is guided on both sides and in limits by way of several guide elements 19 fitted in the fixed structure 5. The guide elements 19 are constructed preferably as guide pins 19.1.

The fixed structure 5 includes several preferably triangular partition plates 20, which are arranged mutually spaced on a bearer element 21 extending transverse to the running direction L (arrow) of the mesh 2 as well as in the region of the return hoop 12 and which enclose at least the fixed guide rail 6 and the movable bearer rail 4 at least partly like a clamp.

Furthermore, the bearer element 21 has on the side facing away from the partition plates 20 several T-groove guides 22 for its attachment to an additional component. The additional component 23 can be for example a non-explicitly illustrated upper mesh suction box of the double mesh section.

The partition plates 20 are equipped on their side facing the mesh 2 with a rear wall 24 which extends transverse to the running direction L (arrow) of the mesh 2 and is fitted by way of at least one guide rail 25 to the partition plates 20. In addition they are also equipped on their side facing away from the mesh 2 with a front wall 26 extending transverse to the running direction L (arrow) of the mesh 2. Of course the two walls 24, 26 can also be constructed in several parts in the interest of improved handling.

For the interior maintenance of the space 28 formed from the bearer body 21, the rear wall 24 and the front wall 26 there is arranged in the upper region of the partition plates 20 a cleaning apparatus 27 extending transverse to the running direction L (arrow) of the mesh 2. The cleaning apparatus 27 is in particular a spray tube 27.1 which is known to those skilled in the art and whose direction of action is orientated to the important components and modules arranged in the space 28.

In addition provision is made in the upper region of the partition plates 20 in a possible embodiment of the air tube for a laterally arranged injection 32 by way of which a fluid, in particular air, can be injected continuously, periodically or according to demand in order to create a positive pressure in the interior space. The injection thus serves above all to prevent mist getting into the interior space and to minimize further the accumulation of dirt in the interior space. The injected fluid (represented by arrows) can escape in favorable manner selectively via an air outlet gap 33 extending between the bearer rail 4 and the rear wall 24 transverse to the running direction L (arrow ) of the mesh 2.

FIG. 2 shows a schematic side view of the rail 1 (shown in FIG. 1) for the compliant supporting of a mesh 2 (represented by a dashed line) in the region of a double mesh section of a machine for producing a fibrous web, in particular a paper web or paperboard web, in its resting position. In this position the rail 1 is lifted by way of the compliant return apparatus 11 from the mesh 2.

As already mentioned in the description of FIG. 1, the compliant return apparatus 11 has, spread over the length of the movable bearer rail 4 extending transverse to the running direction L (arrow) of the mesh 2, several movable return 12 hoops which at the one end 12.1 can made to engage at least temporarily with the movable bearer rail 4 and at the other end 12.2 can be loaded at least temporarily by at least one return element 13 respectively arranged between the fixed guide rail 6 and the movable return hoop 12.

While in the resting position, the respective return hoop 12 is moved into an upper position by the return hose 15 which is loaded with a pressure pR (arrow). The pressure pA (arrow) is generated by a pressure source (not illustrated but known to those skilled in the art), for example in the form of a pressure pump preferably with open-loop/closed-loop control.

Figure 3:
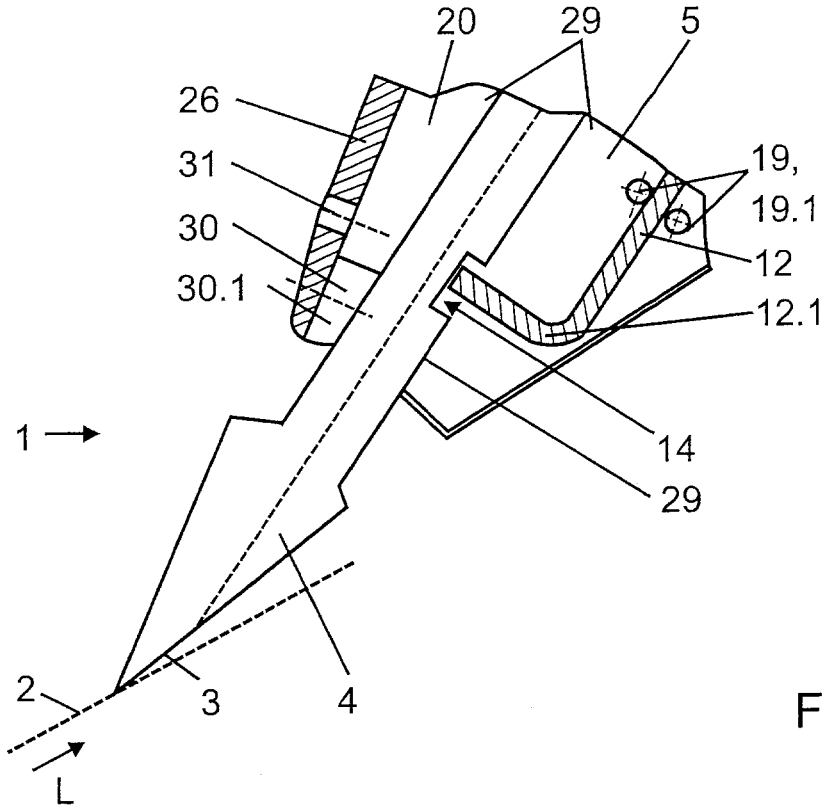
FIG. 3 is a schematic detailed view of the lower part of the inventive rail from FIG. 1.

FIG. 3 shows a schematic detailed view of the lower part of the rail presented in FIG. 1.

The movable bearer rail 4, which is rigidly connected to the movable head rail 3 and extends likewise transverse to the running direction L (arrow) of the mesh 2 (represented by a dashed line), is tilt-resistantly guided in the fixed structure 5. For this purpose the structure 5, which is constructed as partition plates 20, has several guide faces 29.

Arranged between the front wall 26 and the movable bearer rail 4 are seal elements 30, in particular seal rails 30.1, extending at least in some sections transverse to the running direction L (arrow) of the mesh 2 (represented by a dashed line). With due regard to design aspects, the seal rails 30.1, which are fitted by way of several screws 31 to the front wall 26, extend at least between the partition walls 20.

In addition it is evident that the return hoop 12 can be made to engage with its end 12.1 at least temporarily in the depression 14, which has the preferred form of a rectangular recess, in the movable bearer rail 4. The return hoop 12 is guided on both sides and in limits by way of several guide elements 19 fitted in the partition plate 20. The guide elements 19 are constructed preferably as guide pins 19.1.

Figure 4:
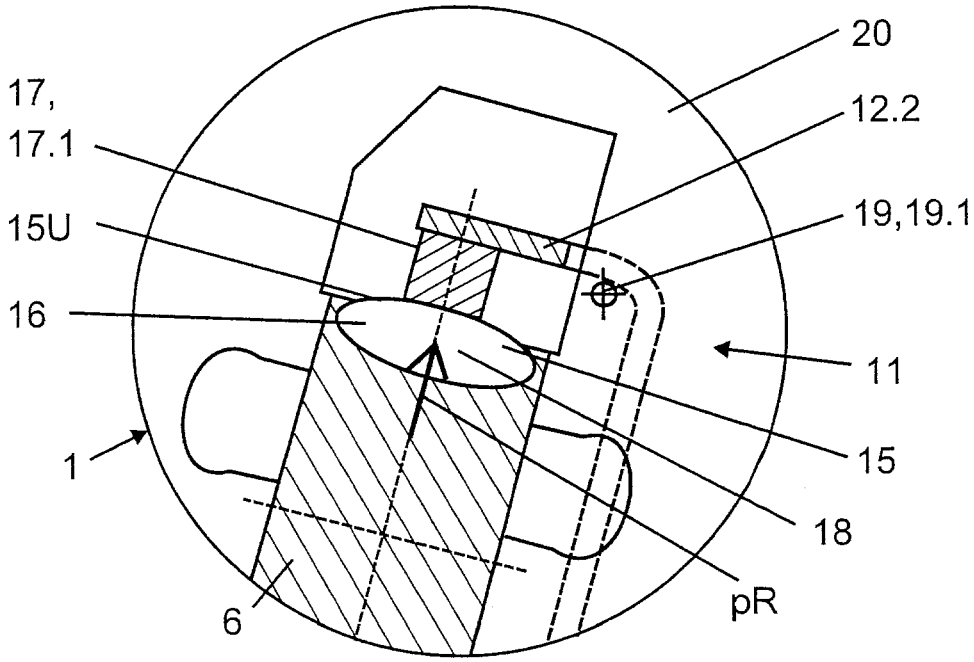
FIG. 4 is another schematic detailed view of the upper part of the inventive rail from FIG. 1.

FIG. 4 shows a schematic detailed view of the upper part of the rail 1 presented in FIG. 1.

The fixed guide rail 6 has on its upper side a recess 16 in which the return hose 15 of the return apparatus 11 is guided, at least in some regions, in respect of its circumference 15U, in particular at least on the bottom side. The fixed guide rail 6 thus serves as a carrier system for the return hose 15.

The return hose 15 can be loaded at least temporarily with a pressure pA (arrow) which is generated by a pressure source (not illustrated but known to those skilled in the art), for example in the form of a pressure pump preferably with open-loop/closed-loop control.

The return hose 15 extends at least between the two edge-side return hoops 12 along the fixed guide rail 16. On the one end 12.2 of the respective return hoop 12 there is attached on the inner side the centering element 17, in particular the centering pin 17.1. The centering pin 17.1 can be loaded at least temporarily by a longitudinal rib 18 constructed on the return hose 15 on the upper side (FIG. 2).

In addition the return hoop 12 is guided on both sides and in limits by way of several guide elements 19 fitted in the partition plate 20. The guide elements 19 are constructed preferably as guide pins 19.1.

Figure 5:
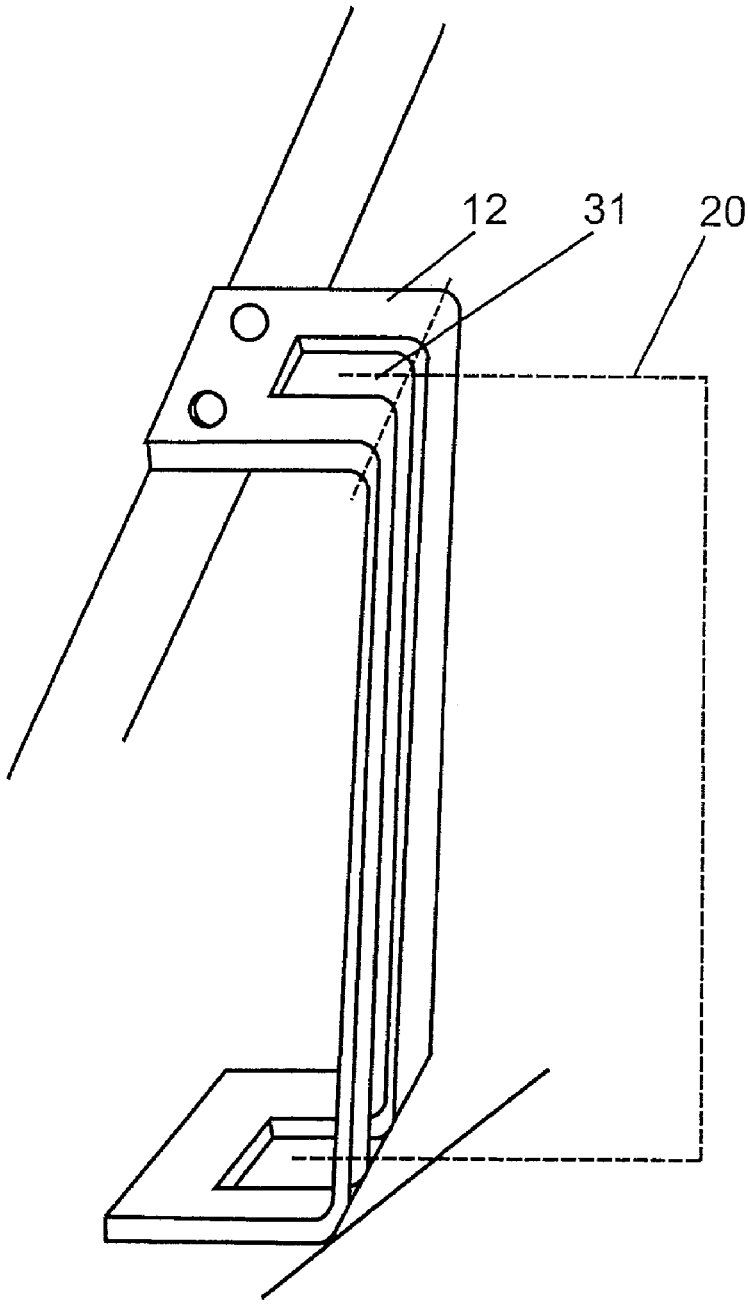
FIG. 5 is a schematic detailed view of the return hoop of the inventive rail from FIG. 1.

Finally FIG. 5 shows a schematic perspective view of the return hoop 12 of the rail 1 from FIG. 1.

It is evident that the return hoop 12 is equipped with a preferably central longitudinal recess 31 in which the related partition plate 20 (only indicated) is guided.

The rail 1 shown in FIGS. 1 to 5 is suitable in particular for use as a skimmer rail or dewatering rail in a double mesh section of a machine for producing a fibrous web, in particular a paper web or paperboard web. Of course the double mesh section can have several such dewatering rails.

In summary it is to be recorded that the invention creates a rail of the type initially referred to whose positions, in particular its operating position and resting position, can be adopted and held reliably during operation with the application of far less force. In particular the return mechanism of the rail has largely no effect on the holding forces of said rail when the rail is in its operating position.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

1 Rail
2 Mesh
3 Head rail
4 Bearer rail
5 Structure
6 Guide rail
7.1, 7.2 Groove connection
8 Pressing apparatus
9 Pressing hose
9U Circumference
10 Depression
10.1 Groove
11 Return apparatus
12 Return hoop
12.1 End
12.2 End
13 Return element
14 Depression
15 Return hose
15U Circumference
16 Depression
16.1 Groove
17 Centering element
17.1 Centering pin
18 Longitudinal rib
19 Guide element
19.1 Guide pin
20 Partition plate
21 Bearer body
22 T-groove guide
23 Component
24 Rear wall
25 Guide rail
26 Front wall
27 Cleaning apparatus
27.1 Spray tube
28 Space
29 Guide face
30 Seal element
30.1 Seal rail
31 Longitudinal recess
32 Injection
33 Air outlet gap
F Force (arrow)
L Running direction (arrow)
pA Operating pressure (arrow)
pR Pressure (arrow)
V Vertical
α Angle

What is claimed is:

1. A rail for the compliant supporting of a mesh in a region of a machine for producing a web of fibrous material, the region corresponding to a double mesh zone of a double mesh section of the machine, said rail comprising:

a movable head rail extending transverse to a running direction of the mesh and being that over which the mesh slides at least in a plurality of regions of the mesh during operation of the machine;

a fixed structure;

a movable bearer rail which is rigidly connected to said movable head rail, extends transverse to said running direction of the mesh, and is guided in said fixed structure;

a fixed guide rail which is rigidly arranged in said fixed structure and extends transverse to said running direction of the mesh;

a compliant pressing apparatus which is arranged between said movable bearer rail and said fixed guide rail in order to move said movable bearer rail together with said movable head rail between a resting position and an operating position in which said movable head rail can be pressed with a selectable force onto the mesh;

a return element; and a compliant return apparatus for moving said movable bearer rail together with said movable head rail from said operating position to said resting position and for holding said movable head rail and said movable bearer rail in said resting position, said compliant return apparatus having, spread over a length of said movable bearer rail, a plurality of movable return hoops each of which has a first end and a second end, each said movable return hoop at said first end configured for being made to engage at least temporarily with said movable bearer rail and at said second end configured for being loaded at least temporarily by at least one said return element respectively arranged between said fixed guide rail and said movable return hoop.

2. The rail according to claim 1, wherein said movable bearer rail has at least one depression into which said first ends of said plurality of movable return hoops can be made to engage at least temporarily.

3. The rail according to claim 1, wherein said movable bearer rail has a plurality of depressions into which corresponding said first ends of said plurality of movable return hoops can be made to engage at least temporarily.

4. The rail according to claim 1, wherein a respective said return element is a return hose which can be loaded with a pressure at least temporarily.

5. The rail according to claim 4, wherein said plurality of movable return hoops includes two edge-side movable return hoops, said return hose extending at least between said two edge-side movable return hoops along said fixed guide rail.

6. The rail according to claim 4, wherein said fixed guide rail includes an upper side defining a depression, at least in a plurality of regions of said return hose said return hose being guided, in respect of a circumference of said return hose, in said depression on said upper side of said fixed guide rail.

7. The rail according to claim 4, wherein said fixed guide rail includes an upper side defining a depression, at least in a plurality of regions of said return hose said return hose being guided, in respect of a circumference of said return hose and at least on a bottom side of said return hose, in said depression on said upper side of said fixed guide rail.

8. The rail according to claim 4, further comprising a centering element and a longitudinal rib, said movable return hoop including an inner side, said return hose including an upper side, said longitudinal rib being formed on said upper side of said return hose, wherein on said first end of a respective said movable return hoop there is attached on said inner side said centering element, which can be loaded at least temporarily by said longitudinal rib.

9. The rail according to claim 8, wherein said centering element is a centering pin.

10. The rail according to claim 1, further comprising a plurality of guide elements fitted in said fixed structure, each said movable return hoop including two sides and being guided on both said two sides and in a plurality of limits by said plurality of guide elements fitted in said fixed structure.

11. The rail according to claim 10, wherein each said guide element is a guide pin.

12. The rail according to claim 1, further comprising a bearer element, the rail including a region of said plurality of movable return hoops, wherein said fixed structure includes a plurality of partition plates which are arranged mutually spaced on said bearer element extending transverse to said running direction of the mesh as well as in said region of said plurality of movable return hoops and which enclose at least said fixed guide rail and said movable bearer rail at least partly like a clamp.

13. The rail according to claim 12, wherein said plurality of partition plates are a plurality of triangular partition plates.

14. The rail according to claim 12, further comprising an additional component, wherein said bearer element has on a side of said bearer element facing away from said plurality of partition plates a plurality of T-groove guides for attaching said bearer element to said additional component.

15. The rail according to claim 12, wherein each said partition plate includes, on a side of each said partition plate facing the mesh, a rear wall extending transverse to said running direction of the mesh.

16. The rail according to claim 15, further comprising at least one guide rail, wherein said rear wall is fitted by at least one said guide rail to a respective said partition plate.

17. The rail according to claim 12, wherein each said partition plate includes, on a side of each said partition plate facing away from the mesh, a front wall extending transverse to said running direction of the mesh.

18. The rail according to claim 17, further comprising a plurality of seal elements which extend transverse to said running direction of the mesh and which are arranged between said front wall and said movable bearer rail at least in a plurality of sections of the rail.

19. The rail according to claim 18, wherein each said seal element is a seal rail.

20. The rail according to claim 17, further comprising a plurality of seal elements which extend transverse to said running direction of the mesh and which are arranged between said front wall and said movable bearer rail at least between said plurality of partition plates.

21. The rail according to claim 12, further comprising a cleaning apparatus extending transverse to said running direction of the mesh, each said partition plate including, on a side of each said partition plate facing the mesh, a rear wall extending transverse to said running direction of the mesh, each said partition plate further including, on a side of each said partition plate facing away from the mesh, a front wall extending transverse to said running direction of the mesh, said bearer element, said rear wall, and said front wall forming a space, said cleaning apparatus being configured for an interior maintenance of said space and being arranged in an upper region of said plurality of partition plates.

22. The rail according to claim 21, wherein said cleaning apparatus is a spray tube.

23. The rail according to claim 12, further comprising a plurality of guide elements fitted in said fixed structure, each said movable return hoop including two sides and being guided on both said two sides and in a plurality of limits by said plurality of guide elements fitted in said fixed structure, at least one said movable return hoop including a longitudinal recess in which a corresponding said partition plate is guided, said plurality of guide elements for guiding respectively said plurality of movable return hoops being fitted to a corresponding said partition plate.

24. The rail according to claim 23, wherein each said guide element is a guide pin.

25. The rail according to claim 23, wherein said longitudinal recess is a central longitudinal recess.

26. A double mesh section of a machine for producing a web of fibrous material, said double mesh section comprising:

- a skimmer rail for the compliant supporting of a mesh in a region of the machine, said region corresponding to a double mesh zone of the double mesh section of the machine, said skimmer rail including:
  - a movable head rail extending transverse to a running direction of said mesh and being that over which said mesh slides at least in a plurality of regions of said mesh during operation of the machine;
  - a fixed structure;
  - a movable bearer rail which is rigidly connected to said movable head rail, extends transverse to said running direction of said mesh, and is guided in said fixed structure;
  - a fixed guide rail which is rigidly arranged in said fixed structure and extends transverse to said running direction of said mesh;
  - a compliant pressing apparatus which is arranged between said movable bearer rail and said fixed guide rail in order to move said movable bearer rail together with said moveable head rail between a resting position and an operating position in which said movable head rail can be pressed with a selectable force onto said mesh;

a return element; and a compliant return apparatus for moving said movable bearer rail together with said movable head rail from said operating position to said resting position and for holding said movable head rail and said movable bearer rail in said resting position, said compliant return apparatus having, spread over a length of said movable bearer rail, a plurality of movable return hoops each of which has a first end and a second end, each said movable return hoop at said first end configured for being made to engage at least temporarily with said movable bearer rail and at said second end configured for being loaded at least temporarily by at least one said return element respectively arranged between said fixed guide rail and said movable return hoop.

27. A double mesh section of a machine for producing a web of fibrous material, said double mesh section comprising:

at least one dewatering rail for the compliant supporting of a mesh in a region of the machine, said region corresponding to a double mesh zone of the double mesh section of the machine, said at least one dewatering rail including:

a movable head rail extending transverse to a running direction of said mesh and being that over which said mesh slides at least in a plurality of regions of said mesh during operation of the machine;

a fixed structure;

a movable bearer rail which is rigidly connected to said movable head rail, extends transverse to said running direction of said mesh, and is guided in said fixed structure;

a fixed guide rail which is rigidly arranged in said fixed structure and extends transverse to said running direction of said mesh;

a compliant pressing apparatus which is arranged between said movable bearer rail and said fixed guide rail in order to move said movable bearer rail together with said moveable head rail between a resting position and an operating position in which said movable head rail can be pressed with a selectable force onto said mesh;

a return element; and a compliant return apparatus for moving said movable bearer rail together with said movable head rail from said operating position to said resting position and for holding said movable head rail and said movable bearer rail in said resting position, said compliant return apparatus having, spread over a length of said movable bearer rail, a plurality of movable return hoops each of which has a first end and a second end, each said movable return hoop at said first end configured for being made to engage at least temporarily with said movable bearer rail and at said second end configured for being loaded at least temporarily by at least one said return element respectively arranged between said fixed guide rail and said movable return hoop.

28. The double mesh section according to claim 27, wherein said at least one dewatering rail includes a plurality of dewatering rails arranged in said running direction of said mesh.

* * * * *